US010054387B2

(12) United States Patent
Engel

(10) Patent No.: US 10,054,387 B2
(45) Date of Patent: Aug. 21, 2018

(54) AUTONOMOUS AUTOMATIC ELECTROMAGNETIC LAUNCH SYSTEM WITH ADJUSTABLE LAUNCH VELOCITY, LOW RECOIL FORCE, LOW ACOUSTIC REPORT, AND LOW VISIBLE AND INFRA-RED SIGNATURE

(71) Applicant: Thomas Gregory Engel, Columbia, MO (US)

(72) Inventor: Thomas Gregory Engel, Columbia, MO (US)

( * ) Notice: Subject to any disclaimer, the term of this patent is extended or adjusted under 35 U.S.C. 154(b) by 55 days.

(21) Appl. No.: 15/453,592

(22) Filed: Mar. 8, 2017

(65) Prior Publication Data

US 2017/0314887 A1 Nov. 2, 2017

Related U.S. Application Data

(60) Provisional application No. 62/305,760, filed on Mar. 9, 2016.

(51) Int. Cl.
*F41B 6/00* (2006.01)

(52) U.S. Cl.
CPC ..... *F41B 6/003* (2013.01)

(58) Field of Classification Search
CPC ..... F41B 6/003
See application file for complete search history.

(56) References Cited

U.S. PATENT DOCUMENTS 4,319,168 A * 3/1982 Kemeny ..... F41B 6/006 104/282
4,343,223 A * 8/1982 Hawke ..... H05H 1/54 124/3
4,714,003 A * 12/1987 Kemeny ..... F41B 6/006 124/3
4,841,181 A * 6/1989 Kemeny ..... F41B 6/006 124/3
5,081,901 A * 1/1992 Kemeny ..... F41G 3/12 124/3
5,182,254 A * 1/1993 Owens ..... F41B 6/006 124/3
5,183,956 A * 2/1993 Rosenberg ..... F41B 6/00 102/374
5,249,030 A * 9/1993 Field ..... G01B 9/02002 356/487
5,969,297 A * 10/1999 Ambs ..... G01V 1/155 181/113
6,622,713 B1 * 9/2003 Thomas ..... F41B 6/00 124/3

(Continued)

*Primary Examiner* — Troy Chambers
*Assistant Examiner* — Bridget A Cochran
(74) *Attorney, Agent, or Firm* — Erickson Kernell IP, LLC

(57) ABSTRACT

Apparatus for electromagnetic launching system for the linear acceleration of macro particles. The apparatus disclosed is autonomously-powered, compact, and lightweight. The apparatus disclosed has low recoil force, low acoustic report, and low visible and infra-red signature. The apparatus disclosed is capable of automatic operation and the maximum particle velocity can be adjusted. The apparatus disclosed includes a trigger, controller, component power source, particle container, particle loader, propellant container, propellant loader, igniter, combustion chamber, sound suppressor, linear electrical generator, linear electrical motor, and thermal barrier.

7 Claims, 5 Drawing Sheets

(56) References Cited

U.S. PATENT DOCUMENTS

| | | | | |
|---|---|---|---|---|
| 7,357,128 | B1 * | 4/2008 | Baumgart | F41B 6/006 124/3 |
| 7,832,385 | B1 * | 11/2010 | Kapinski | F41B 6/006 124/3 |
| 9,146,069 | B2 * | 9/2015 | Monti | F41A 33/06 |
| 2003/0137377 | A1 * | 7/2003 | Engel | F41B 6/003 335/220 |
| 2004/0020351 | A1 * | 2/2004 | Yurievich | F41B 6/003 89/8 |
| 2013/0015295 | A1 * | 1/2013 | Campbell | F41B 6/003 244/158.5 |
| 2014/0060508 | A1 * | 3/2014 | Floyd | F41B 6/003 124/3 |
| 2016/0341514 | A1 * | 11/2016 | Grace | F41A 1/02 |

* cited by examiner

AUTONOMOUS AUTOMATIC ELECTROMAGNETIC LAUNCH SYSTEM WITH ADJUSTABLE LAUNCH VELOCITY, LOW RECOIL FORCE, LOW ACOUSTIC REPORT, AND LOW VISIBLE AND INFRA-RED SIGNATURE

REFERENCE TO RELATED APPLICATIONS

This application claims an invention which was disclosed in Provisional Application No. 62/305,760, filed Mar. 9, 2016, entitled "RECOILLESS AUTONOMOUSLY POWERED ELECTROMAGNETIC RIFLE". The benefit under 35 U. S. C. § 119(e) of the United States provisional application is hereby claimed, and the aforementioned application is hereby incorporated herein by reference.

ACKNOWLEDGMENT OF GOVERNMENT SUPPORT

No government support was used in the development of this patent.

BACKGROUND

High-speed linear electrical motors, often referred to as electromagnetic launchers, have been proposed for many defense, aerospace, and industrial applications where linear motion is needed or desired to accelerate or convey macroscopic particles including guns, cannons, missile launchers, torpedo launchers, decoy and countermeasure launchers, aircraft launchers, spacecraft launchers, satellite launchers, asteroid miners, lunar miners, shock and vibration testers, and other applications and devices. In these types of applications, the linear electrical motor is part of a larger system called the electromagnetic launching system (ELS). The ELS comprises a primary power source (PPS), an intermediate energy storage network (IES), and a linear electrical motor (LEM).

BRIEF SUMMARY OF THE INVENTION

The present invention provides an ELS that is compact, lightweight, and autonomously-powered that can be used in any of the applications listed above regardless of scale. The present invention does not require access to an external electrical power source and is, therefore, especially useful for mobile ELS applications. The present invention can be used for practically any energy, particle diameter, and particle mass ELS. The present invention allows the maximum particle launch velocity to be adjusted, has low recoil force, has low acoustic report, and has low visible and infra-red signature.

The present invention provides among other things a compact, lightweight, and autonomously-powered automatic electromagnetic launching system (ELS) for accelerating macroscopic particles in a linear direction. The present invention provides for adjustable maximum particle launch velocity and has low recoil force, low acoustic report, and low visible and infra-red signature.

The present invention does not require an external source of electrical power. The present invention uses a small power source such as a battery or capacitor to provide a small amount of electrical energy to excite (i.e., seed) a linear electrical generator (LEG). The armature of the LEG is mechanically coupled with movable pistons to a combustion chamber wherein propellant is combusted. Energy from the combusting propellant moves the LEG armature amplifying the seed energy so that the LEG generates electrical power. The electrical power is directed to the linear electrical motor (LEM) to accelerate the particles and to the low-power electrical source to re-charge it for subsequent use. Using the low-power source, LEG, and LEM in this manner results in a lightweight, compact, and autonomously-powered ELS.

A controller manages the functions and operation of the present invention. The controller in conjunction with a power supply and power distribution mechanism feeds particles and propellant to the ELS as required and needed. The controller in conjunction with an igniter initiates the process of combustion. The controller in conjunction with the power supply provides LEG seeding. The controller manages recharging of the low-power source. The controller manages automatic operation of the present invention.

The present invention has a low recoil force compared to conventional chemical (i.e., gunpowder) guns because the LEM acceleration forces are constant over the acceleration length. The recoil of the present invention is further reduced when a double-ended combustion chamber with two opposing LEG generators is employed. The opposing LEG generators can be seeded in such a way as to produce a forward impulse that counteracts the backward impulse produced by particle acceleration. The LEG seeding method determines the magnitude of the forward impulse. The LEG seeding method is used to adjust the maximum particle launch velocity.

The present invention has low acoustic report and low visual and infra-red signature. The LEM eliminates the acoustic report found in all chemical (i.e., gunpowder) guns as it uses electromagnetic forces for acceleration. The electromagnetic acceleration forces produced by the LEM also eliminates the muzzle flash found in all chemical guns. The propellant combusted in the present invention is released to the environment through an acoustic suppressor to reduce and/or eliminate acoustic report. A thermal barrier encloses the component parts of the present invention to reduce and/or eliminate the emission of infra-red radiation.

DETAILED DESCRIPTION

Components

Figure 1:
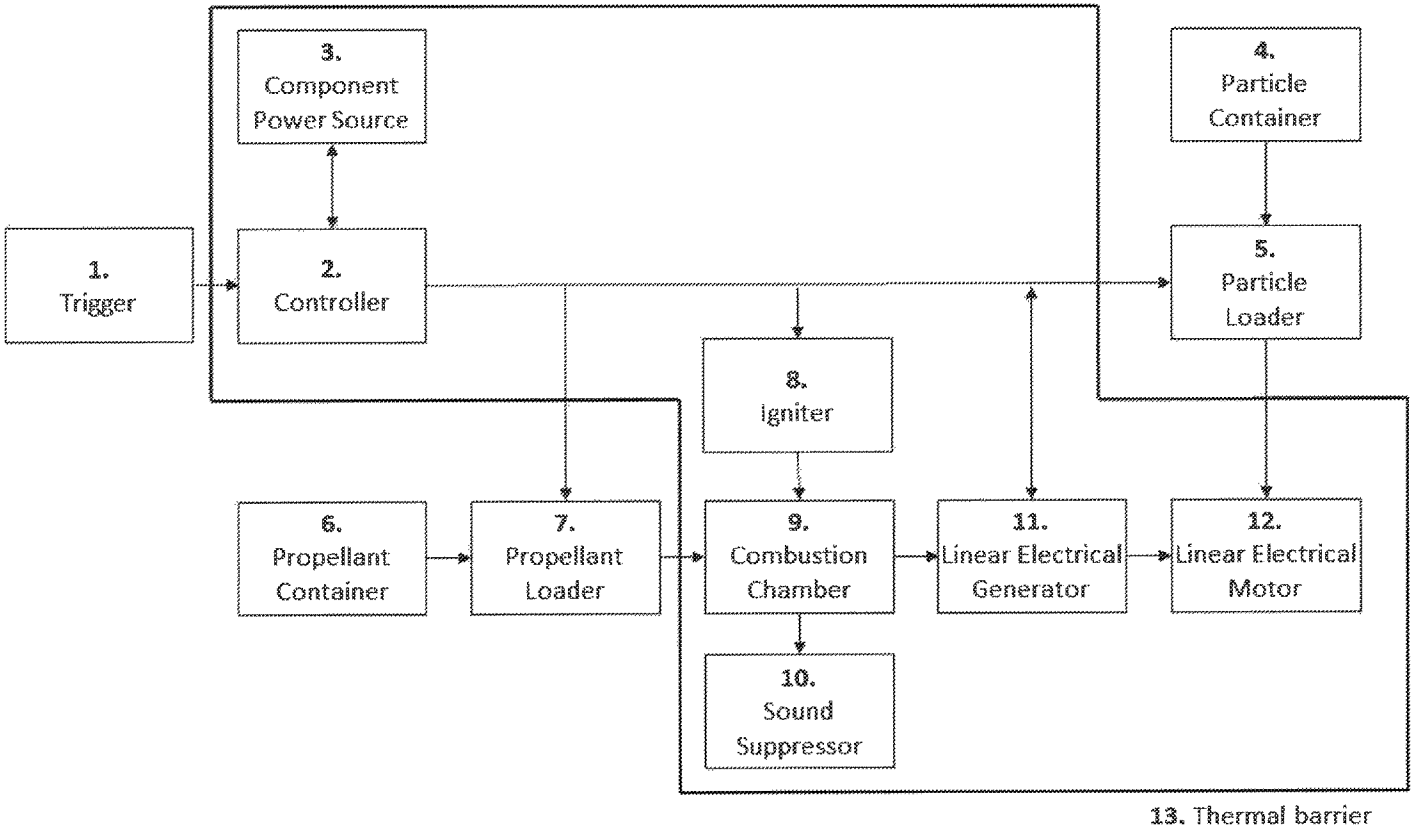
FIG. 1 is a block diagram of the present invention illustrating its component parts and their couplings.

The invention provides among other things an autonomous automatic electromagnetic launch system for accelerating macroscopic particles in a linear direction. The present invention provides for adjustable maximum particle launching velocity and has low recoil force, low acoustic report, and low visible and infra-red signature. Referring to FIG. 1, the present invention comprises a trigger 1, controller 2, component power source 3, particle container 4, particle loader 5, propellant container 6, propellant loader 7, igniter 8, combustion chamber 9, sound suppressor 10, linear electrical generator 11, linear electromagnetic motor 12, and thermal barrier 13, generally mounted in a housing 30. The operation of the present invention and its components are described below.

Propellant and Loader

Referring to FIG. 1, the propellant container 6 comprises a container holding propellant that is mechanically coupled to the propellant loader 7 in a manner to allow said propellant to be directed to said loader. The propellant container 6 can hold a loose quantity of propellant or can hold propellant in pre-formed or pre-measured quantities. The propellant loader 7 comprises an electrically activated and powered electrical and/or mechanical mechanism to direct propellant into the combustion chamber 9 when activated. Said propellant container is mechanically coupled to said combustion chamber to accomplish said task. The propellant loader 7 mechanism can direct pre-measured or pre-formed propellant into the combustion chamber 9 or function to measure a prescribed amount of propellant prior to directing it into said combustion chamber. The propellant comprises a fuel and oxidizer that is in solid, liquid, or gaseous form. The propellant loader 7 further comprises an electrical coupling to the controller 2.

Particles and Loader

Referring to FIG. 1, the particle container 4 comprises a container to hold one or more particles and is mechanically coupled to the particle loader 5 in a manner to allow particles to be directed to said loader. The particle loader 5 comprises an electrically activated and powered electrical and/or mechanical mechanism that directs said particles into the linear electrical motor 12 and is mechanically coupled to said linear electrical motor to accomplish said task. The particle loader 5 further comprises an electrical coupling to the controller 2.

Combustion Chamber, Igniter, and Sound Suppressor

Referring to FIG. 1, the combustion chamber 9 comprises a container with an opening to accept propellant directed into it by the propellant loader 7 and will contain the combustion of said propellant so that gas pressure is created within said container. The combustion chamber 9 is further comprised of an opening to allow mechanical access by the igniter 8. The igniter 8 is comprised of an electrical coupling to the controller 2. The igniter 8 is further comprised of an electrically activated and powered electrical and/or mechanical ignition source to initiate combustion of the propellant at a time determined by the controller 2. The combustion chamber 9 is further comprised of an opening to allow one or more moveable pistons that are mechanically coupled to one or more armatures of the linear electrical generator 11. The combustion chamber 9 is further comprised of an opening and mechanical coupling to the sound suppressor 10 wherein combustion gases are directed at a time prescribed by the position of said pistons in said combustion chamber. The sound suppressor 10 comprises a container to accommodate the expansion and cooling of said combustion gases. The sound suppressor 10 further comprises one or more internal baffles and one or more internal ports. The sound suppressor 10 further comprises one or more openings to allow passage of expanded and cooled combustion gases to the environment.

Linear Electrical Generator

Referring to FIG. 1, the linear electrical generator 11 comprises one or more armatures and one or more stators. The linear electrical generator 11 further comprises one or more pistons mechanically coupled to said armatures that are mechanically coupled to the combustion chamber 9. Said pistons can move in the combustion chamber 9. The linear electrical generator 11 further comprises an electrical coupling to the linear electrical motor 12. The linear electrical generator 11 further comprises operation in one cycle comprising a forward stroke wherein the armature travels said linear electrical generator's length in one direction and a return stroke wherein the armature travels said linear electrical generator's length in the reverse direction. Said linear electrical generator further comprises a mechanical and/or electrical mechanical to assist said piston movement in return direction.

Linear Electrical Motor

Referring to FIG. 1, the linear electrical motor 12 comprises one or more armatures and one or more stators. The linear electrical motor 12 further comprises a mechanical coupling to accept particles from the particle loader 5 in a manner to allow said particles to be accelerated. Said particles further comprise said armatures to be accelerated in the linear electrical motor 12.

Controller, Component Power Source, and Operation

Referring to FIG. 1, the component power source 3 comprises an electrical power source that is electrically coupled to the controller 2. Said controller further comprises an electrical coupling to the trigger 1, propellant loader 7, particle loader 5, igniter 8, and linear electrical generator 11. In the preferred embodiment, the physical size of the component power source 3 is relatively small. The component power source 3 only needs enough power for one actuation of the particle loader 5, one actuation of the propellant loader 7, one actuation of the igniter 8, and one energization of the linear electrical generator 11 and may be, therefore, physically small. The controller 2 comprises the electronic hardware, mechanical hardware, and software required to accomplish the above said functions.

After receiving the start command from the trigger 1, the controller 2 directs power from the component power source 3 to the particle loader 5 which loads one or more particles into the linear electrical motor 12. Said controller also directs power from the said component power source to the propellant loader 7 which loads propellant into the combustion chamber 9. Said controller also directs power from the said component power source to the linear electrical generator 11 to excite it with a small amount of energy, herein called the seed energy. Said controller also directs power from the said component power source to the igniter 8 which initiates combustion of said propellant in said combustion chamber. The said controller comprises the electronic hardware, mechanical hardware, and software required to accomplish the above said functions.

Said pistons move by pressure created in the combustion chamber 9 resulting from combusting propellant therein located and, by doing so, extract and convert energy from the combusting propellant. Said pistons will move said armatures of the linear electrical generator 11 causing said linear electrical generator to amplify said seed energy thereby generating electrical power.

Said electrical coupling between the controller 2 and the linear electrical generator 11 further comprises the means to extract energy to recharge the component power source 3 in a manner determined by the controller 2. A fraction of the electrical power generated by the linear electrical generator 11 is directed to the controller 2 to recharge the component power source 3. The remaining electrical power generated by the linear electrical generator 11 is directed to the linear electrical motor 12 and used to accelerate said particles and said armatures. The controller 2 comprises the electronic hardware, mechanical hardware, and software required to accomplish the above said functions.

Thermal Barrier

Referring to FIG. 1, the thermal barrier 13 comprises a thermally reflective material enclosing the controller 2, component power source 3, igniter 8, combustion chamber 9, sound suppressor 10, linear electrical generator 11, and linear electromagnetic motor 12. The thermal barrier 13 further comprises thermally absorptive materials. The thermal barrier 13 functions by preventing the emission of infra-red radiation from the present invention.

PREFERRED EMBODIMENT

Figure 2:
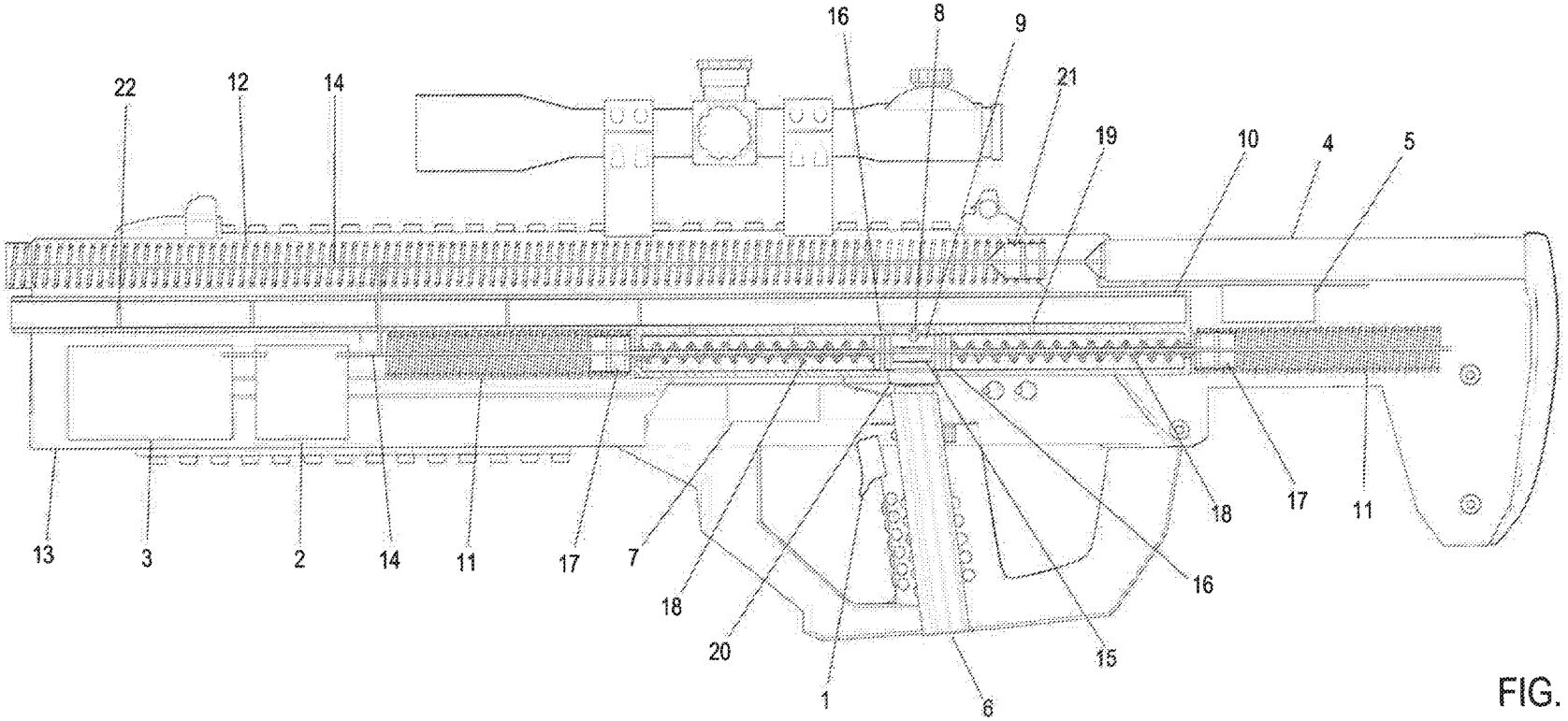
FIG. 2 is a side view according to the preferred type of embodiment of the present invention.
Figure 3:
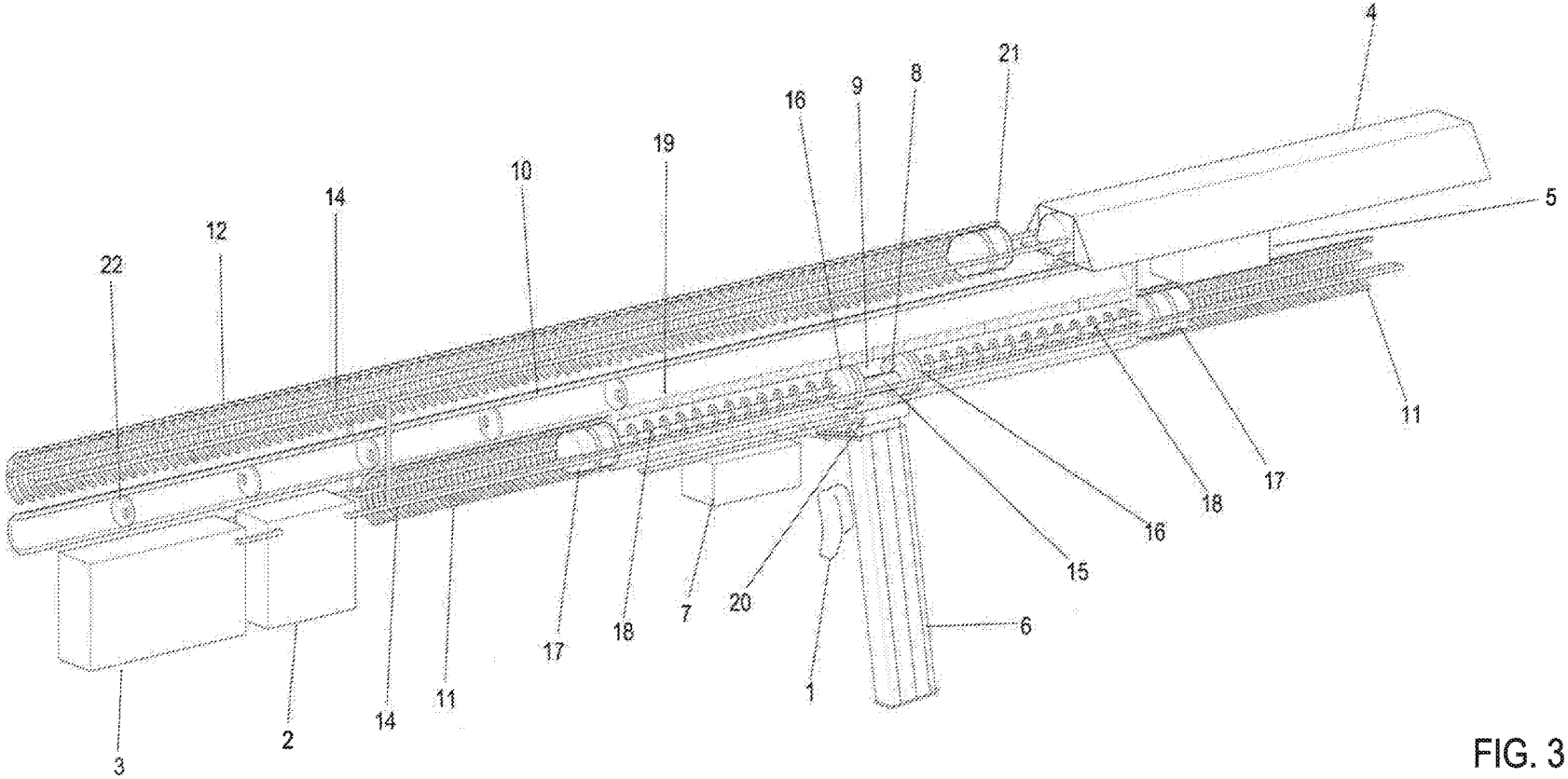
FIG. 3 is an oblique side view according to the preferred type of embodiment of the present invention with the housing and thermal barrier removed.
Figure 4:
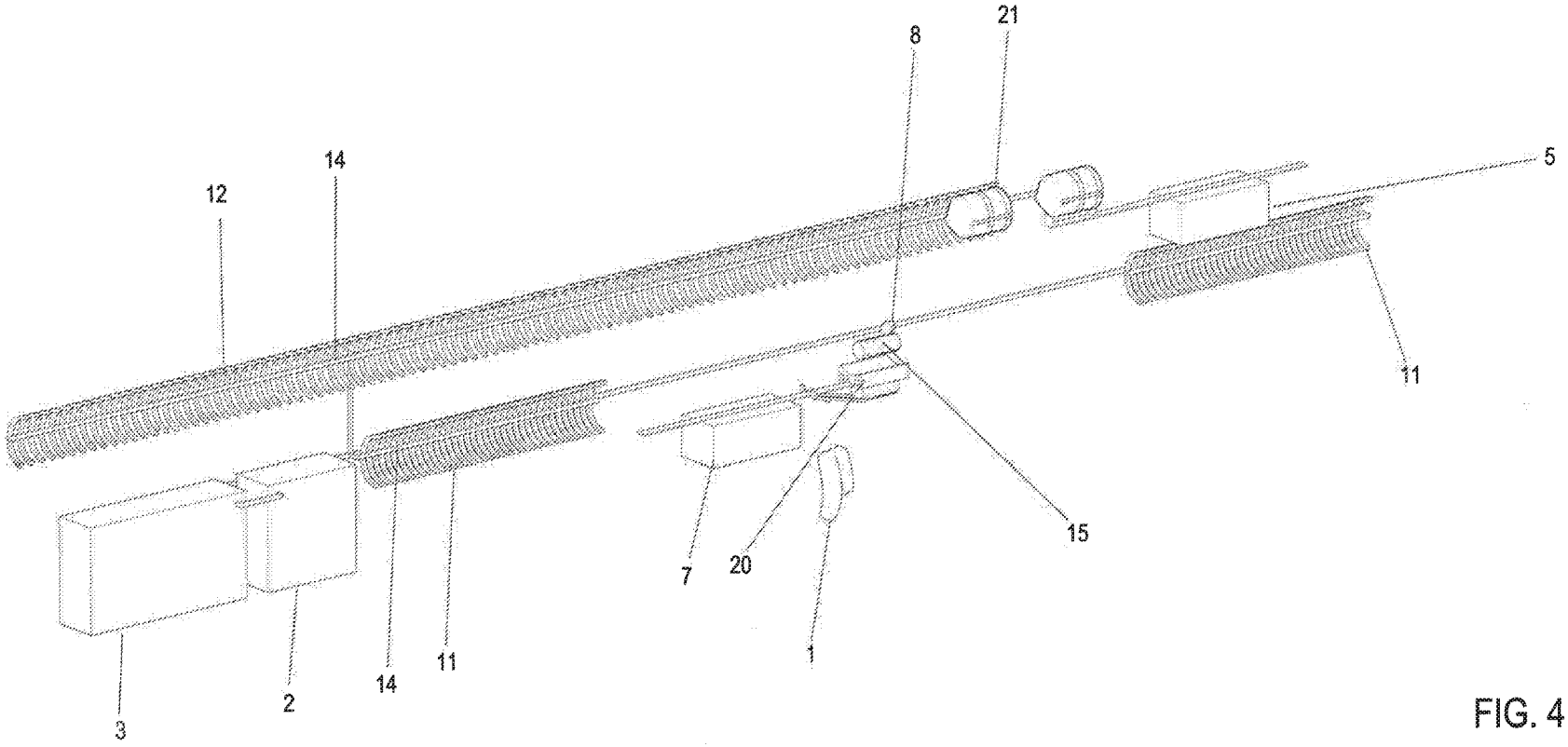
FIG. 4 is an oblique side view according to the preferred type of embodiment of the present invention with the combustion chamber, particle container, propellant container, and sound suppressor removed.
Figure 5:
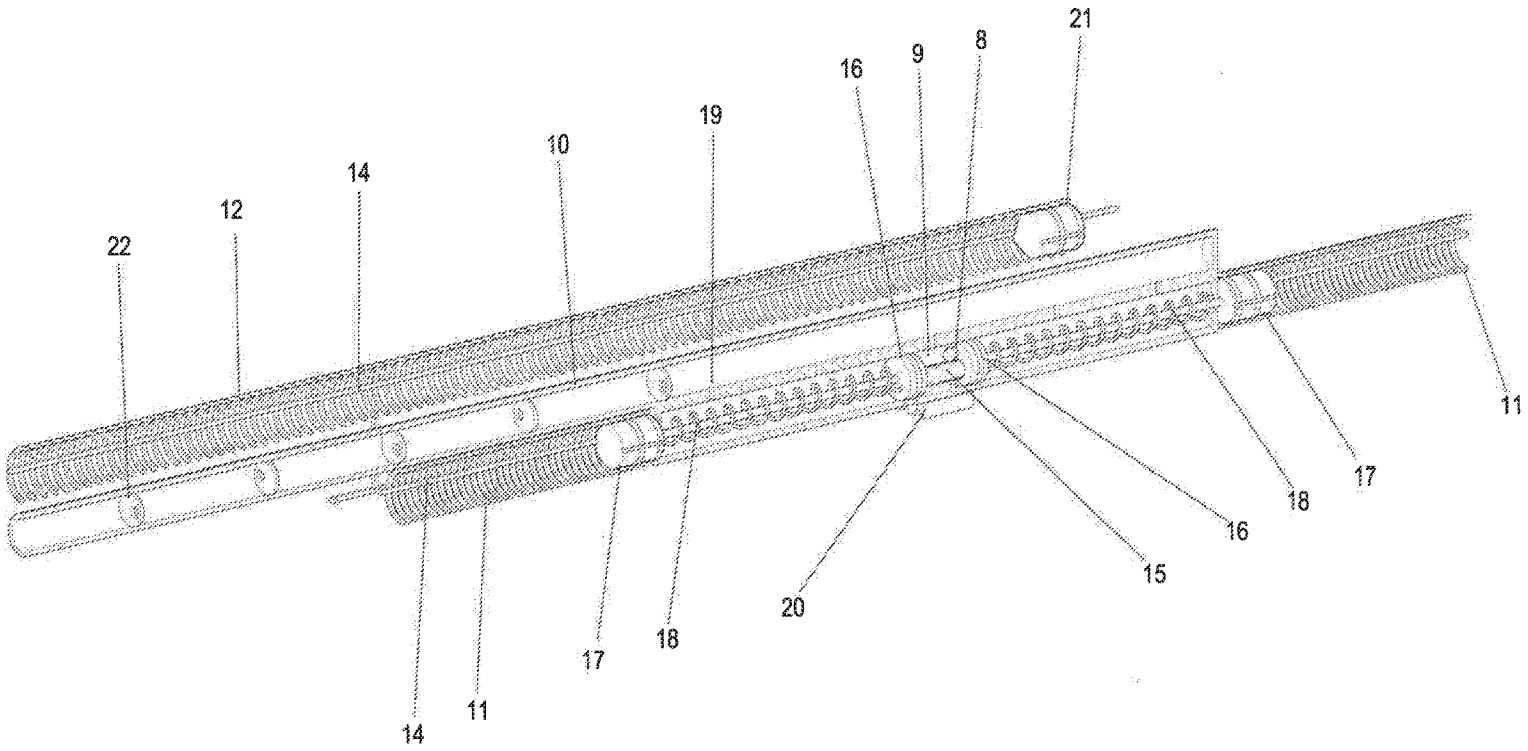
FIG. 5 is an oblique side view according to the preferred type of embodiment of the present invention with the trigger, component power source, particle container, particle loader, propellant container, propellant loader.

The preferred embodiment of the present invention is shown in FIG. 2. Accordingly, it is to be understood that the embodiment of the invention herein described is merely illustrative of the application of the principles of the invention. Reference herein to details of the illustrated embodiment is not intended to limit the scope of the claims, which themselves recite those features regarded as essential to the invention.

Referring to FIG. 2 through FIG. 5, the preferred embodiment of the present invention is a mobile, man-portable electromagnetic rifle. The thermal barrier 13 serves the dual purpose of housing the components of the preferred embodiment of the present invention and preventing the emission of infra-red radiation. Said housing mechanically couples the components of the preferred embodiment of the present invention in a rigid fashion that prevents relative movement of said components.

Referring to FIG. 2 through FIG. 5, the trigger 1 is implemented with an electrical switch that is electrically coupled (not shown) to the controller 2. Said controller of the preferred embodiment of the present invention is implemented with a field-programmable gate array. The component power source 3 of the preferred embodiment of the present invention is implemented with a rapidly rechargeable lithium battery. Said component power source is electrically coupled to said controller with conductive buss-bars 14.

Referring to FIG. 2 through FIG. 5, the preferred embodiment of the present invention comprises a propellant container 6 and particle container 4 that are essentially spring-fed magazine-style containers that are commonly used with conventional firearms. The propellant 15 is implemented with so-called "powder pellets". Said powder pellets are commercially available solid chemical propellant charges used in conventional firearms that have no bullet casing and are completely combustible. Said powder pellets have a combustible binder to shape and hold said chemical propellant prior to combustion. The propellant loader 7 loads the propellant 15 into the combustion chamber 9. A combustion chamber block 20 seals said combustion chamber after said propellant is loaded. The particle loader 5 loads the particle 21 into the linear electrical motor 12. The particle 21 is the armature of said linear electrical motor in the preferred embodiment of the present invention.

Referring to FIG. 2 through FIG. 5, the igniter 8 is electrically coupled (not shown) to the controller 2. Said igniter is essentially an electrical spark igniter powered by a high voltage generator located in the controller 2. Said igniter provides ignition energy to the propellant 15. Once ignited, said propellant pressurizes the combustion chamber 9 causing the pistons 16 located within said combustion chamber to move. Said pistons are mechanically coupled to the armatures 17 of the linear electrical generator 11. Said armature moves with said pistons.

Referring to FIG. 2 through FIG. 5, the preferred embodiment of the present invention comprises one linear electrical motor 12 and two linear electrical generators 11. The linear electrical motor 12 and linear electrical generator 11 comprises any suitable DC (direct current) or AC (alternating current) linear electrical motor and linear electrical generator. The linear electrical motor used in the preferred embodiment of the present invention is the helical electromagnetic launcher. The helical electromagnetic launcher operating in the generator mode is also the said linear electrical generator for the preferred embodiment of the present invention. The linear electrical generator 11 is designed so that its armature will not move as fast as the particle (i.e., armature) being accelerated from the linear electrical motor 12. Said linear electrical generator will therefore have a shorter stroke than the linear electrical motor. A slow moving linear electrical generator armature is beneficial in terms of efficiently converting the combusting propellant 15 into mechanical motion. The inductance gradient of said linear electrical generator must be larger than that of said linear electrical motor if their different stroke lengths occur in the same amount of time. The inductance gradient of said helical electromagnetic launcher can be designed over a large range. The inductance gradient of each of the two said linear electrical generators used in the preferred embodiment of the present invention are equal.

Referring to FIG. 2 through FIG. 5, the linear electrical motor 12 and linear electrical generator 11 in the preferred embodiment of the present invention are coupled in a parallel electrical connection via connecting buss-bars 14. Said electrical coupling extends to the controller 2. Said controller energizes said linear electrical generator with a said seed energy. Armature 17 movement in said linear electrical generator produced by combusting propellant 15 amplifies said seed energy resulting in said linear electrical generator producing electrical power. Said linear electrical generator provides power via said electrical coupling to the particle 21 of said linear electrical motor and accelerates said particle in a linear manner. Electrical power produced by said linear electrical generator is directed to said controller which subsequently directs it to the component power source 3 thereby recharging said component power source. The amount of said seed energy supplied to said linear electrical generators determines the maximum particle velocity.

The linear electrical motor 12 and linear electrical generator 11 in the preferred embodiment of the present invention can be electrically coupling in a series electrical connection instead of the parallel electrical connection described in the previous paragraph. Said series electrical coupling of said linear electromagnetic generators and said linear electrical motor will make each of the armatures of said linear electrical generator travel at a different velocity providing a method for additional recoil force reduction. With each armature of said linear electrical generator travelling at different velocities, the center of mass of the assembly comprised with the two said linear electrical generators will be shifted in the forward or reverse direction thereby generating a net impulse in the forward or reverse direction respectively. Said net generator impulse will cancel the impulse produced from particle acceleration thereby reducing total recoil impulse and forces.

Referring to FIG. 2 through FIG. 5, the pistons 16 located in the combustion chamber 9 will move past a plurality of combustion chamber outlet ports 19 which allows the release of combustion gases produced by the combusting propellant 15 into the sound suppressor 10. Said combustion chamber outlet ports are linearly and symmetrically located along the axial length of said combustion chamber. The release of said combustion gases through said combustion chamber outlet ports will reduce the pressure of the acoustic wave front through the process of gas expansion and through a process known as destructive interference. The said combustion gases are allowed to further expand as they pass through a plurality of baffles 22 located internally and along the axial length of said sound suppressor. The said combustion gases are sufficiently expanded and cooled to be released to the surrounding environment with only a minimal report as they exit said sound suppressor. Return springs 18 located in said combustion chamber return said pistons to their original location.

The above processes can be repeated after the completion of the above described process thereby enabling sustained automatic operation of the preferred embodiment of the present invention.

The present invention can be scaled to any level to be used in any ELS application to accelerate particles of any caliber or mass. The present invention is especially applicable to mobile, man-portable applications such an electromagnetic rifle described by the preferred embodiment of the present invention and illustrated in FIG. 2 through FIG. 5.

While various embodiments of the present invention have been shown and described, it should be understood that other modifications, substitutions, and alternatives are apparent to one of ordinary skill in the art. Such modifications, substitutions and alternatives can be made without departing from the spirit and scope of the invention, which should be determined from the appended claims.

Having thus described the invention, what is claimed as new and desired to be secured by Letters Patent is as follows:

1. A linear particle accelerator comprising: a particle container containing one or more particles; a particle loader coupled to said particle container and receiving said particles therefrom; a propellant container containing a propellant; a propellant loader coupled to said propellant container and receiving said propellant therefrom; a combustion chamber coupled to said propellant loader and receiving said propellant therefrom; an igniter; a linear electrical generator having one or more armatures coupled to said combustion chamber, and one or more stators; a linear electrical motor electrically coupled to said linear electrical generator; a trigger; a controller coupled to said trigger, said propellant loader, said particle loader and said igniter; and a component power source; wherein said component power source is electrically coupled to said controller which is subsequently electrically coupled to said particle loader, said propellant loader, said igniter, said linear electrical generator, said trigger and said linear electrical motor; wherein said igniter is mechanically coupled to said combustion chamber; wherein said combustion chamber is mechanically coupled to said linear electrical generator; wherein said linear electrical generator is electrically coupled to said linear electrical motor; and wherein upon actuation of said trigger, said controller energizes said linear electrical generator with a seed energy to move said armature in said linear electrical generator produced by combusting said propellant to amplify said seed energy resulting in said linear electrical generator producing electrical power, said linear electrical generator provides power via said electrical coupling to a particle in said linear electrical motor and accelerates said particle in a linear manner.

2. The linear particle accelerator of claim 1 wherein the electrical power produced by said linear electrical generator is directed to said controller which directs it to the component power source thereby recharging said component power source.

3. The linear particle accelerator of claim 1 wherein the amount of said seed energy supplied to said linear electrical generators determines the maximum particle velocity.

4. The linear particle accelerator of claim 1 further comprising a piston coupled to said one or more armatures of said linear electrical generator and positioned within said combustion chamber.

5. The linear particle accelerator of claim 4 wherein said armature is operable to move said piston in a forward stoke and a return stroke.

6. The linear particle accelerator of claim 1 further comprising first and second pistons arranged in a collinear opposing orientation and coupled to said armature of said linear electrical generator, said first and second pistons positioned within said combustion chamber.

7. The linear particle accelerator of claim 6 wherein said armature is operable to move said first piston in a forward stroke and said second piston in a return stroke, and move said first piston in a reverse stroke and said second piston in a forward stroke.

* * * * *